United States Patent [19]

Ogasawara et al.

[11] Patent Number: 4,481,982

[45] Date of Patent: Nov. 13, 1984

[54] WEFT PULL-BACK DEVICE OF A JET WEAVING LOOM

[75] Inventors: Takashi Ogasawara; Tetsuzi Hasebe; Masayuki Koriyama, all of Tokyo, Japan

[73] Assignee: Nissan Motor Company, Limited, Yokohama, Japan

[21] Appl. No.: 518,916

[22] Filed: Aug. 1, 1983

[30] Foreign Application Priority Data

Aug. 4, 1982 [JP] Japan ..... 57-135094

[51] Int. Cl.[3] ..... D03D 47/34

[52] U.S. Cl. ..... 139/435; 139/450

[58] Field of Search ..... 139/429, 435, 443, 450, 139/194

[56] References Cited

U.S. PATENT DOCUMENTS

| | | | |
|---|---|---|---|
| 2,089,620 | 8/1937 | Rossmann | 139/450 |
| 3,269,426 | 8/1966 | Llado | 139/450 |
| 3,329,176 | 7/1967 | Fluhmann | 139/194 |
| 3,698,442 | 10/1972 | Sakamoto | 139/435 |

FOREIGN PATENT DOCUMENTS

| | | | |
|---|---|---|---|
| 2752094 | 6/1978 | Fed. Rep. of Germany | 139/435 |
| 1336177 | 7/1963 | France | 139/435 |

*Primary Examiner*—Henry S. Jaudon

*Attorney, Agent, or Firm*—Schwartz, Jeffery, Schwaab, Mack, Blumenthal & Koch

[57] ABSTRACT

In a jet weaving loom having a frame, a reed holder pivotally movable relative to the frame in the downstream and upstream directions with respect to the motion of the warp threads, a jet nozzle mounted on the reed holder to move therewith and ejecting the weft thread into the shed of the warp threads by the jet action thereof, and a weft gripper secured to the frame for selectively gripping and releasing the weft thread advancing toward the jet nozzle, so that when the reed holder moves in the downstream direction toward a first extreme position, the beating and the weft cutting are carried out, and when the reed holder moves in the upstream direction and comes to a second extreme position, the weft picking is actually carried out, there is provided a weft pull-back device which catches the weft thread extending between the weft gripper and the jet nozzle when the reed holder is positioned in the vicinity of the first extreme position, and holds the same for a predetermined period of time when the reed holder moves in the upstream direction toward the second extreme position after completing the beating and the weft cutting.

14 Claims, 11 Drawing Figures

FIG. 7a1
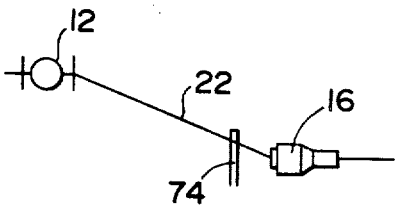
FIG. 7a2
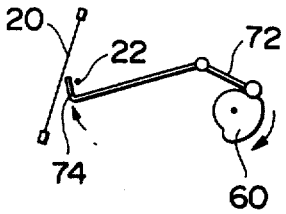
FIG. 7b1
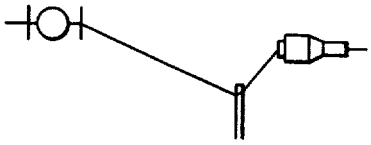
FIG. 7b2
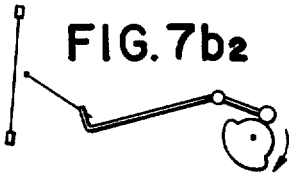
FIG. 7c1
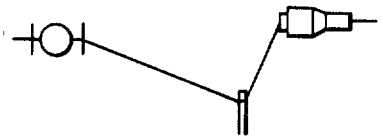
FIG. 7c2
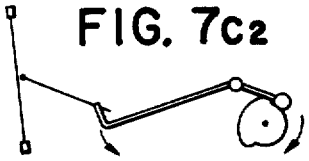
FIG. 7d1
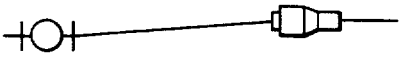
FIG. 7d2
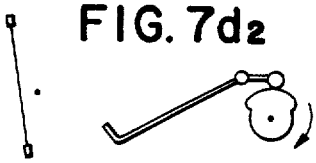

WEFT PULL-BACK DEVICE OF A JET WEAVING LOOM

BACKGROUND OF THE INVENTION

The present invention relates in general to a jet weaving loom such as air jet loom and water jet loom, and more particularly to a weft pull-back device of such looms, which, prior to effecting the actual weft picking, pulls back the weft thread from the jet nozzle to reduce the length of the weft thread (or "dag") hanging out of the end of the nozzle in order to prevent the undesired tangling of the dag with the warp threads which would occur at the pre-jet operation of the nozzle.

SUMMARY OF THE INVENTION

According to the present invention, there is provided a weft pull-back device which is constructed to effect its weft pull-back operation by skillfully using the pivoting motion of the reed holder of the loom. Thus, the weft pull-back device of the invention is simple in construction.

According to the present invention, there is provided, in a jet weaving loom having a frame, a reed holder pivotally movable relative to the frame in the downstream and upstream directions with respect to the motion of the warp threads, a jet nozzle movable with the reed holder and ejecting the weft thread into the shed of the warp threads by the jet action thereof, and a weft gripper for intermittently stopping the movement of the weft thread toward the jet nozzle, so that when the reed holder moves in the downstream direction toward a first extreme position, the beating and the weft cutting are carried out, and when the reed holder moves in the upstream direction and comes to a second extreme position, the weft picking is actually carried cut, a weft pull-back device which catches the weft thread extending between the weft gripper and the jet nozzle when the reed holder is positioned in the vicinity of the first extreme position, and holds the same for a predetermined period of time when the reed holder moves in the upstream direction toward the second extreme position after completion of the beating and the weft cutting.

BRIEF DESCRIPTION OF THE DRAWINGS

Other objects and advantages of the present invention will become apparent from the following description when taken in conjunction with the accompanying drawings, in which:

FIG. 7 is a diagram showing the conditions of the weft pull-back device of the third embodiment of FIG. 6;

DETAILED DESCRIPTION OF THE INVENTION

Figure 1:
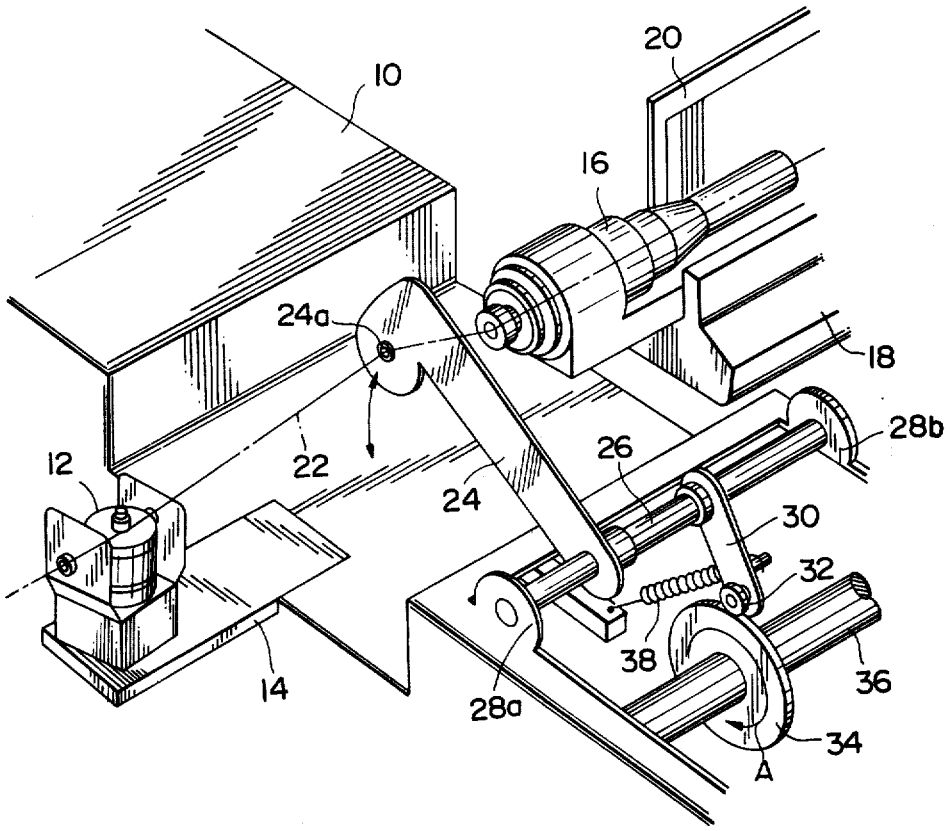
FIG.1 (PRIOR ART)
FIG. 1 is a partial perspective view of a weft picking section of an air jet loom using a conventional weft pull-back device.

Prior to describing the invention in detail, one of the conventional weft pull-back devices will be outlined with reference to FIG. 1 in order to clarify the invention.

In the drawing, the weft picking section of the loom to which the conventional weft pull-back device is mounted is shown. Designated by numeral 10 is a frame of the loom to which a weft gripper 12 is connected through a bracket 14. A jet nozzle 16, such as air jet nozzle or water jet nozzle, is mounted on one end of the reed holder 18 to move therewith. The reed holder 18 holds thereon the reed 20. Under operation, a weft thread 22 moves rightward, but intermittently, through the weft gripper 12 and the jet nozzle 16 in response to the weaving operation of the loom.

The conventional weft pull-back device associated with the above-mentioned weft picking section comprises a weft pull-back arm 24 which is secured at its one end to a pivot shaft 26 which is, in turn, rotatably supported by flanges 28*a* and 28*b* extending from the frame 10. The enlarged free end of the arm 24 is formed with a weft guide hole 24*a* through which the weft thread 22 advancing toward the nozzle 16 passes. A small lever 30 is secured at its one end to the pivot shaft 26 and has at its other end a cam follower 32. The cam follower 32 is rotatably beard on a cam 34 securely mounted on a shaft 36. The shaft 36 rotates about the axis thereof in the direction of the arrow A in response to the weaving operation of the loom. A spring 38 is connected to the lever 30 to bias same and thus the pivot shaft 26 in the clockwise direction in the drawing. With the arrangement stated as above, the rotating movement of the cam 34 is converted to a pivoting movement of the weft pull-back arm 24. In the rest condition of the arm 24, it assumes such a position that the guide hole 24*a* thereof is put on an imaginary straight line connecting the weft gripper 12 and the jet nozzle 16.

When, in operation, beating is finished and the just picked weft thread 22 is cut by a cutter (not shown) at the entrance side of the fell, the weft pull-back arm 24 is gradually raised from its rest position. During this arm raising operation, the weft gripper 12 keepts its weft gripping condition. Thus, the raising of the arm 24 pulls the length of weft thread 22 extending between the end of the jet nozzle 16 and the cutter located at the side of the fell, back into the nozzle 16 so that the "dag" of weft thread, which would otherwise hang out of the end of the jet nozzle 16, is considerably reduced. (It is now to be noted that the shortening of such "dag" is very important because subsequent picking can be made without tangling of the dag with the warp threads. In fact, such tangling would occur at the pre-jet operation of the nozzle 16, viz., at the air jetting with the weft thread 22 being gripped by the weft gripper 12.) When, the pre-jet operation is about to start, the weft pull-back arm 24 starts to lower thereby stopping the pull-back motion of the dag, and when the pre-jet operation starts actually, the shortened dag is forcibly straightened and directed downstream by the jet from the nozzle 16. When the arm 24 comes to its rest position, the substantial weft picking is carried out, viz., the weft gripper 12 releases the weft thread 22 causing the same to be swiftly picked into the shed of the warp threads.

However, the above-mentioned conventional weft pull-back device has suffered from the following drawbacks. That is, due to its inherent construction, the arm 24 has a limitation in length in spite of necessity of pulling back a considerable length (about 40 mm to 50 mm) of the dag. This requires a large stroke of the pivoting motion of the arm 24. Furthermore, the arm 24 must finish each weft pull-back motion thereof within a very short time (about 20 degrees as measured in the loom cycle) from the moment when the shed of the warp threads is sufficiently open to the moment when the weft thread 22 starts its picking motion. These requirements have caused the cam 34 to have an angularly complicated shape (viz., the shape including a highly raised edge and a highly depressed groove), so that every parts of the weft pull-back device are compelled to bear abnormally heavy movements thereof. Thus, the device has failed not only to provide the arm 24 with a quick response relative to the motion of the cam 34, but also to have a practically sufficient durability.

Figure 2:
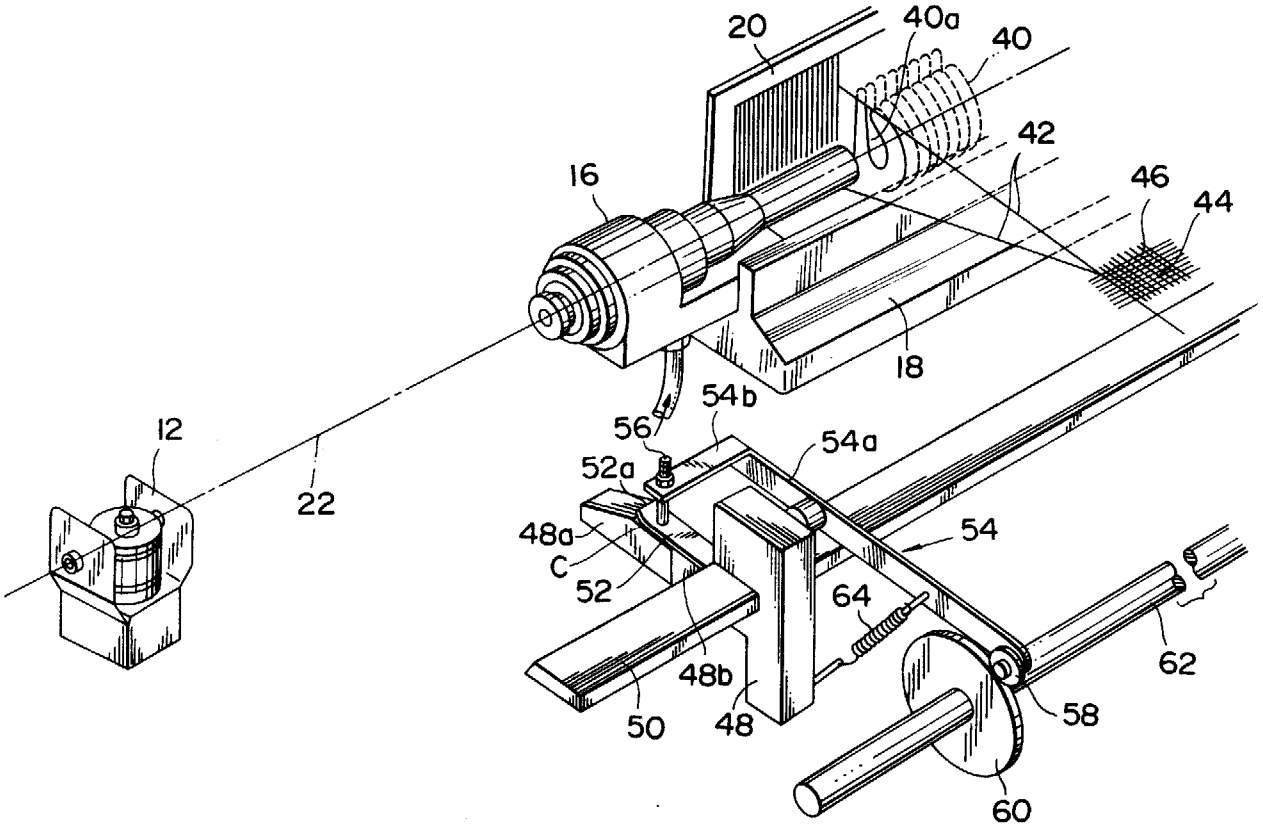
FIG. 2 is a partial perspective view of a weft picking section of an air jet loom employing a weft pull-back device of a first embodiment of the present invention.

Referring to FIG. 2, there is shown a first embodiment of the present invention, which is free of the drawbacks encountered in the above-mentioned conventional device. In the drawing, like parts to those of FIG. 1 are designated by the same numerals. The frame (not shown), the weft gripper 12, the air jet nozzle 16, the reed holder 18 and the reed 20 are constructed and arranged in the same manner as in the case of FIG. 1. However, in FIG. 2, aligned guide members 40, warp threads 42 and woven fabric 44 are shown. Designated by numeral 46 is a cloth fell. The guide holes **40*a* of the guide members 40 define a straight air channel which is arranged coaxial with the air jet nozzle 16**, as shown.

The weft pull-back device of the first embodiment comprises a holder 48 which is connected to a temple bar 50 of the loom. As shown, the holder 48 has an extension **48*a* extending in the upstream direction with respect to the motion of the warp threads 42. The leading end of the extension 48*a* has a slanted surface slanting in the upstream direction. The extension 48*a* is enlarged at its root portion 48*b* thereby to form a step on the upper surface thereof. The height of the step is about 1 mm to about 2 mm. A spring plate 52 made of a resilient material, such as metal, plastics or the like, is attached to the raised root portion 48*b* with a major portion thereof extending over the step in the upstream direction thereby to form a clearance C between the holder's extension 48*a* and the spring plate 52. As shown, the leading end 52*a* of the spring plate 52 terminates at the position where the inboard edge of the slanted surface of the extension 48*a* is located. Furthermore, the leading end 52*a* of the spring plate 52 is curved upward to form a tapered enlarged entrance portion of the clearance C. The holder 48 is positioned so that the clearance C can receive therein the weft thread 22 when the reed holder 18 and thus the air jet nozzle 16 move or swing in the downstream direction, that is, in the direction to effect the beating operation. A generally L-shaped lever 54 consisting of a longer lever section 54*a* and a shorter lever section 54*b* is pivotally connected at the longer lever section 54*a* to the holder 48 so that it is pivotal about an axis perpendicular to the direction in which the warp threads 42 move. The shorter lever section 54*b* extends toward the spring plate 52, as shown. An adjustable screw 56 is connected to the leading end of the shorter lever section 54*b* in such a manner that the lower end of the screw 56 is contactable with the spring plate 52 when the lever 54 assumes a given angular position. The leading end of the longer lever section 54*a* is provided with a cam follower 58. The cam follower 58 is rotatably beard on a cam 60 secured to a shaft 62 which rotates in response to the weaving operation of the loom. A spring 64 is spanned between the longer lever section 54*a* and the holder 48 so that the lever 54 is biased to pivot in the clockwise direction in FIG. 2. With this arrangement, when the cam follower 58 rides on a predetermined raised section of the cam 60, the screw 56 pushed and bends the spring plate 52** to such an extent to close the entrance of the clearance C.

Figure 3:
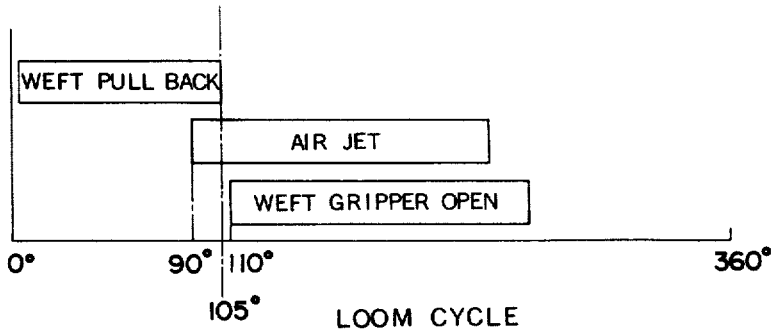
FIG. 3 is a timing chart showing conditions of the weft pull-back device of FIG. 2 against time measured as intervals in degrees of the loom cycle.
Figure 4A:
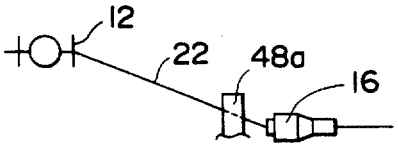
FIG. 4 is a diagram showing the conditions of the weft pull-back device of FIG. 2.
Figure 4:
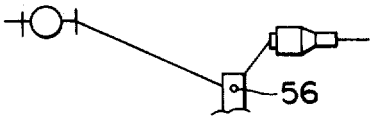
Figure 4:
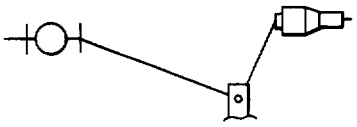
Figure 4:
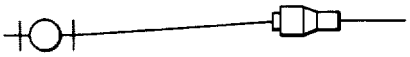

Operation of the weft pull-back device of the first embodiment will be described with reference to FIGS. 2, 3 and 4. When, after completion of the weft picking, the reed 20 and thus the air jet nozzle 16 on the reed holder 18 move in the downstream direction for effecting beating, the weft thread 22 extending between the weft gripper 12 and the air jet nozzle 16 is turned toward the weft pull-back device about the weft gripper 12. During this turning, the weft thread 22 is inserted into the clearance C defined between the holder's extension **48*a* and the spring plate 52 (see FIG. 4**(*a*)). After completion of beating, the weft thread 22 is cut by a cutter (not shown) at the entrance side of the fell. After the weft cutting, the cam follower 58 rides on the raised section of the cam 60 thereby to cause the adjustable screw 56 on the lever 54 to strongly press the spring plate 52 against the upper surface of the holder's extension **48*a*. Thus, the weft thread 22 is caught by the spring plate 52** while being permitted to move axially.

With the weft thread 22 being caught by the spring plate 52, the reed 20 and thus the air jet nozzle 16 on the reed holder 18 move in the upstream direction while making a new shed of the warp threads 42 for the subsequent weft picking. During this moving back operation of the reed 20, the weft gripper 12 keeps its weft gripping condition. Thus, the moving back operation of the reed 20 pulls the "dag" of the weft thread 22 back into the air jet nozzle 16 so that the length of the dag is considerably reduced, as is seen from FIGS. 4(*b*) and 4(*c*). When the pre-jet operation of the air jet nozzle 16 starts, the shortened dag is forcibly straightened and directed downstream by the air jet from the nozzle 16. (As has been mentioned hereinabove, the shortening of the dag prevents the undesired tangling of the weft thread 22 with the warp threads 42 at the pre-jet operation. This advantageous matter can provide the loom with a quick pre-jet start allowing a sufficient pre-jet period for each loom cycle, so that the subsequent weft picking is effected in a stable manner). Upon straightening of the shortened dag, the cam follower 58 of the lever 54 comes to the depressed section of the cam 60 thereby raising the adjustable screw 56 and thus the spring plate 52 from the holder's extension **48*a* and thus releasing the weft thread 22. Thus, the length of the weft thread 22 extending from the weft gripper 12 to the air jet nozzle 16 through the weft pull-back device is forcedly sucked into the air jet nozzle 16** making the straightening small "dag" longer, as is seen from FIG.

4(*d*). In this condition, the new shed of the warp threads 42 becomes completed. Then, the weft gripper 12 releases the weft thread 22 causing same to be swiftly picked into the full open shed of the warp threads 42.

As is understood from the above description, the weft pull-back operation is achieved by moving the spring plate 52 by only 1 mm to 2 mm, unlike the case in the afore-mentioned conventional weft pull-back device. Thus, simplification of the device is achieved in the present invention. Furthermore, considering the advantage in shortening the time period from the moment when the weft thread 22 is released from the weft pull-back device to the moment when the weft thread 22 starts its picking motion, the small stroke (1 mm to 2 mm) of the pivoting motion of the spring plate 52 induces stable weft picking.

Figure 5:
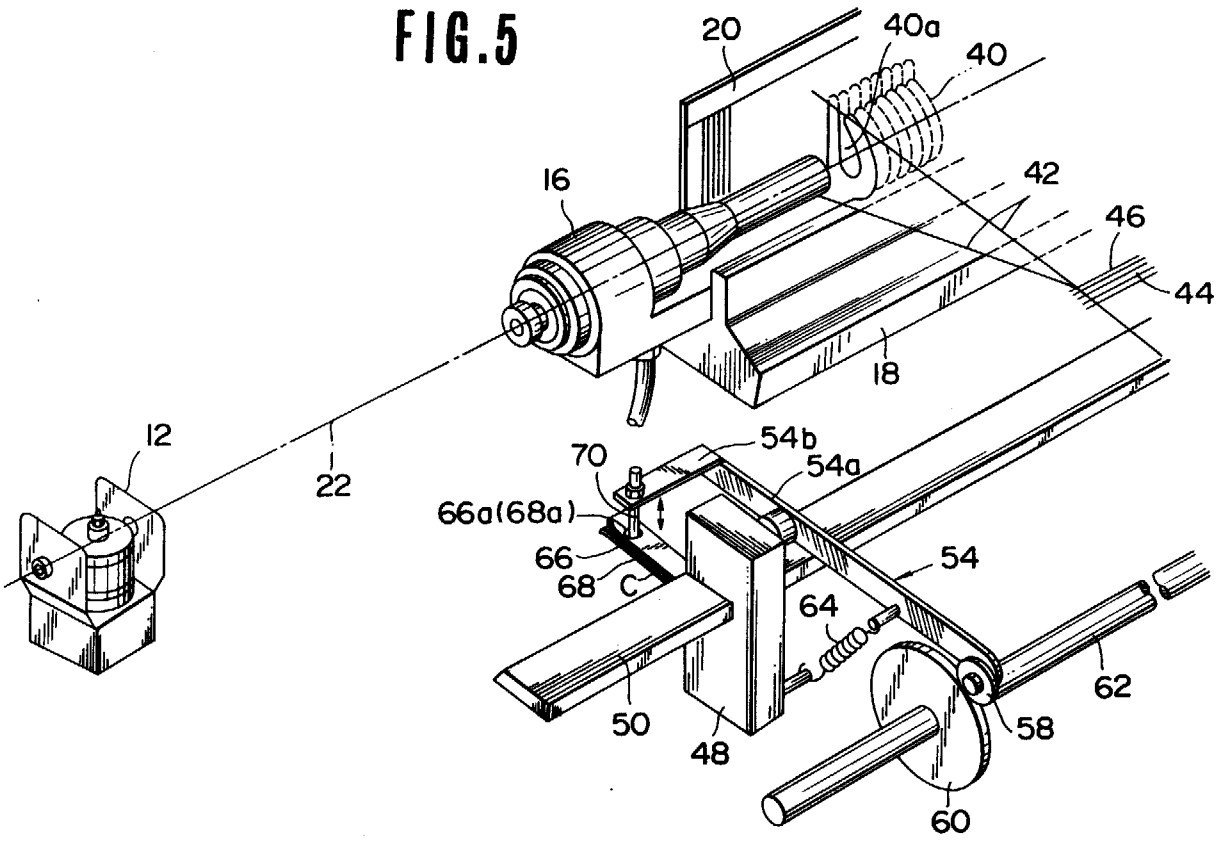
FIG. 5 is a view similar to FIG. 2, but showing a second embodiment of the present invention.

Referring to FIG. 5, there is shown a second embodiment of the present invention. As is seen from this drawing, the weft pull-back device of the second embodiment is substantially the same in construction as that of the first embodiment except for the so-called "work portion". Thus, only the work portion will be described in the following. Identical parts to those of FIG. 2 are designated by the same numerals.

The work portion of the second embodiment comprises a pair of spaced plates 66 and 68 which are secured at their one ends to the holder 48 so that they extend in the upstream direction with respect to the motion of the warp threads 42, these plates 66 and 68 leaving therebetween a clearance C. The leading ends of these plates 66 and 68 are curved upwardly and downwardly, respectively to form a tapered enlarged entrance of the clearance C. These plates 66 and 68 are formed with aligned holes 66*a* and 68*a* into which a pin 70 bolted to the shorter lever section 54*b* of the L-shaped lever 54 is insertable upon pivoting movement of the lever 54. Operation of the second embodiment is substantially the same as that of the first embodiment except that following.

After the weft thread 22 is inserted into the clearance C, the pin 70 is inserted into the aligned holes 66*a* and 68*a* of the paired plates 66 and 68. Thus, the weft thread 22 is caught by the pin 70 while being permitted to move axially. Thus, the subsequent moving back operation of the reed holder 18 pulls the "dag" back into the air jet nozzle 16 in the same manner as has been mentioned in the first embodiment.

Also in this second embodiment, the weft pull-back operation is achieved by moving the pin 70 by only a small distance, like the case of the first embodiment. Thus, substantially the same advantages as those of the first embodiment are achieved.

Figure 6:
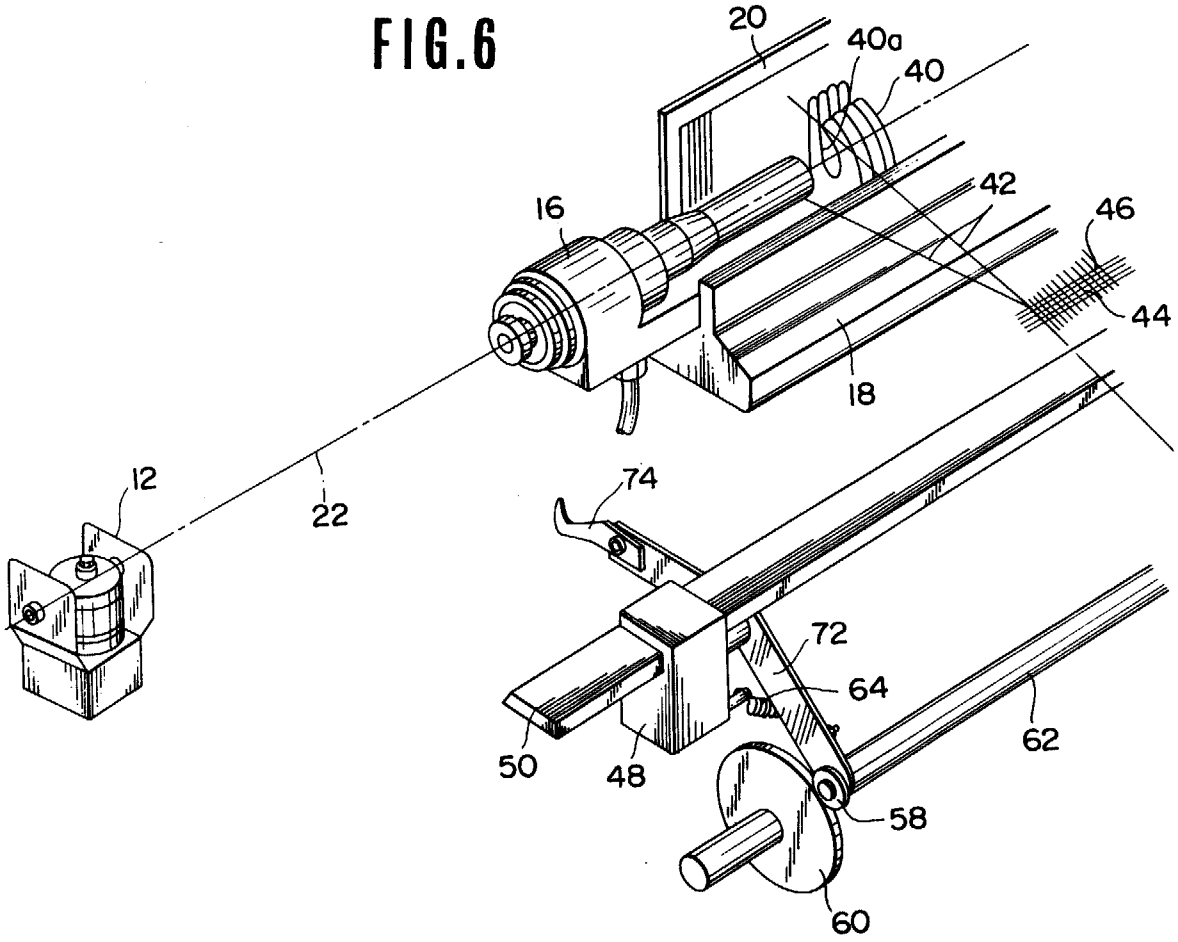
FIG. 6 is a view similar to FIG. 2, but showing a third embodiment of the present invention.

Referring to FIGS. 6 and 7, especially FIG. 6, there is shown a third embodiment of the present invention. The weft pull-back device of this third embodiment comprises a holder 48 connected to the temple bar 50 of the loom. A slightly angled lever 72 is pivotally connected at its middle portion to the inboard side of the holder 48. A hook member 74 is adjustably connected to the extending end of the lever 72, and a cam follower 58 is rotatably connected to the other end of the lever 72 to ride on the cam 60. A spring 64 is spanned between the holder 48 and the lever 72 so that the lever 72 is biased to pivot in the clockwise direction in FIG. 6.

When, in operation, the reed holder 18 and thus the air jet nozzle 16 move in the downstream direction and complete the beating and the weft cutting, the cam follower 58 of the lever 72 drops into a depressed section of the cam 60 causing the hook member 74 to be raised, as is seen from FIGS. 7($a_1$) and 7($a_2$). Thus, the weft thread 22 is caught by the hook member 74 while being permitted to move axially. When, with the weft thread 22 being caught by the hook member 74, the reed holder 18 and thus the air jet nozzle 16 move in the upstream direction while making a new shed of the warp threads 42 for the subsequent weft picking, the "dag" of the weft thread 22 is pulled back into the air jet nozzle 16, as is seen from FIGS. 7($b_1$), 7($b_2$), 7($c_1$) and 7($c_2$). When the pre-jet operation of the air jet nozzle starts, the shortened dag is forcibly straightened and directed downstream by the air jet from the nozzle 16. Upon straightening of the dag, the cam follower 58 rides on the raised section of the cam 60 thereby lowering the hook member 74 and thus causing the same to release the weft thread 22. Thus, the length of the weft thread 22 extending from the weft gripper 12 to the air jet nozzle 16 through the hook member 74 is forcedly sucked into the air jet nozzle 16 making the straightened small dag longer, as is seen from FIGS. 7($d_1$) and 7($d_2$). In this condition, the new shed of the warp threads 42 becomes fully opened. Then, the weft gripper 12 releases the weft thread 22 causing same to be swiftly picked into the new shed of the warp threads 42. Due to the inherent construction of the third embodiment, the stroke of the hook member 74 is somewhat larger than that of the first and second embodiments. However, substantially the same advantages as those of the afore-mentioned first and second embodiments are also achieved in this third embodiment.

Figure 8:
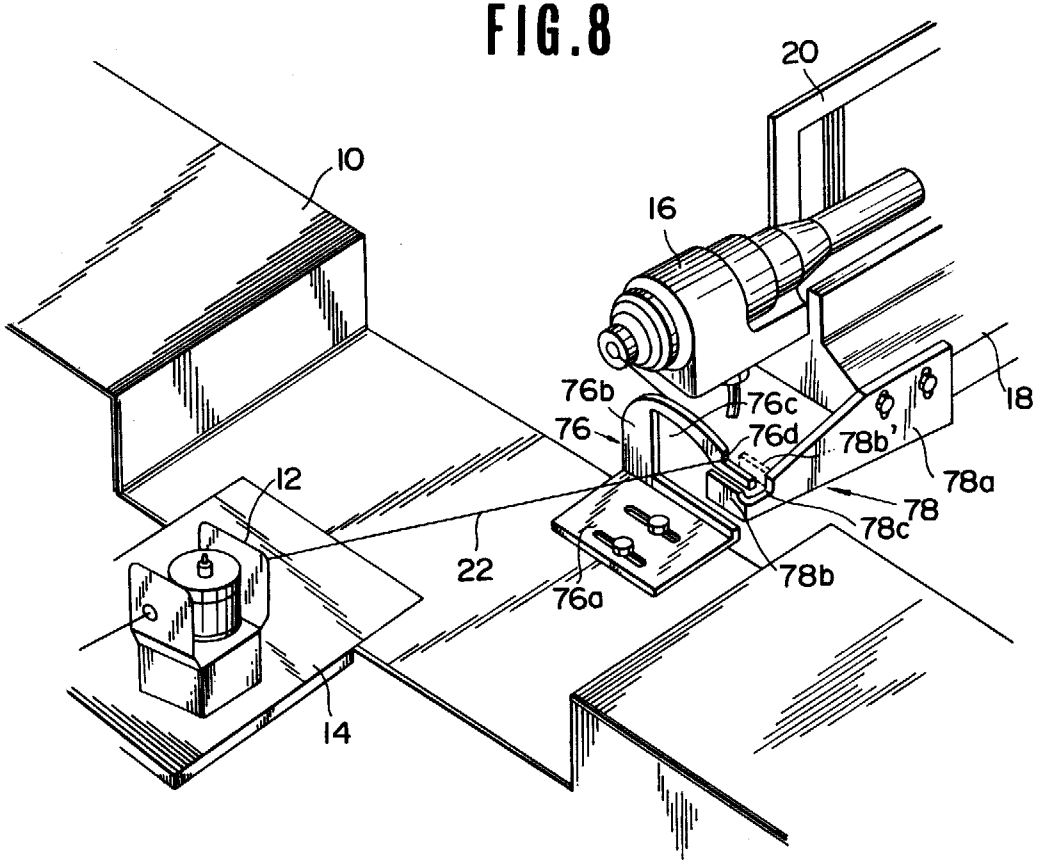
FIG. 8 is a view similar to FIG. 2, but showing a fourth embodiment of the present invention.
Figure 9:
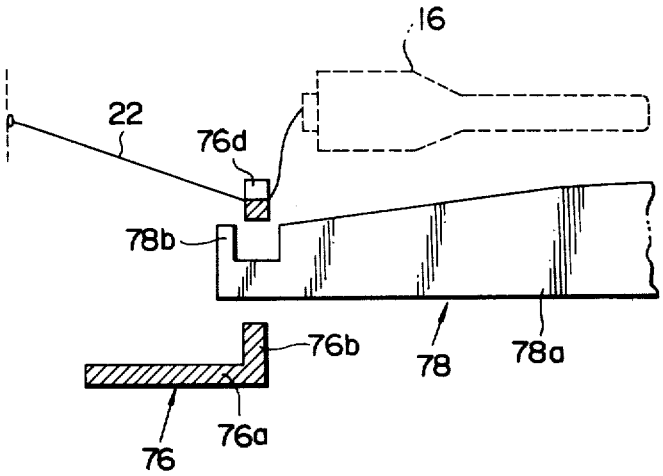
FIGS. 9 and 10 are diagrams showing the principle of the weft pull-back device of the fourth embodiment of FIG. 8.
Figure 10:
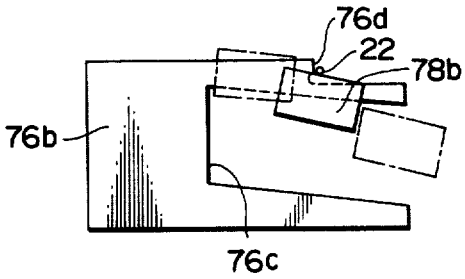

Referring to FIGS. 8, 9 and 10, especially FIG. 8, there is shown a fourth embodiment of the present invention. As will become apparent as the description proceeds, the weft pull-back device of the fourth embodiment is designed to skillfully use the pivoting motion of the reed holder 18. In fact, the pivoting motion producing devices, such as the cam 60, the cam follower 58 and the lever 54 or 72 in the afore-mentioned embodiments are not employed in the fourth embodiment.

The weft pull-back device of the fourth embodiment comprises a weft catching member 76 secured to the frame 10 of the loom, and a weft detaching member 78 secured to the reed holder 18. The weft catching member 76 comprises a base section 76*a* adjustably bolted to the frame 10, and a raised section 76*b* extending upwardly from the base section 76*a*. The raised section 76*b* has a slender upper portion which extends in the downstream direction with respect to the motion of the warp threads (not shown) to form an opening 76*c* facing in the downstream direction of the warp threads. The slender upper portion has a reduced leading end leaving a substantially vertical wall 76*d* formed thereon, which wall faces in the downstream direction. If desired, the wall 76*d* may have a small recess at its lower section, as shown in FIG. 10. The weft catching member 76 is so arranged and constructed that when, after completion of beating and cutting of the weft thread 22, the reed holder 18 and thus the air jet nozzle 16 start the moving-back operation, the vertical wall 76*d* of the weft catching member 76 catches the weft thread 22 in a manner as is shown in FIG. 8. Thus, the subsequent moving back operation of the reed holder 18 pulls the "dag" back into the air jet nozzle 16, like in the manner of the afore-mentioned other embodiments. The weft detaching member 78 comprises a base section 78*a* adjustably bolted to the reed holder 18 and a work section 78*b* extending in the upstream direction from the base section 78a. The base section 78a is formed, at the portion near the work section 78b, with a recess 78c. As is understood from FIG. 8, the weft detaching member 78 extends toward the frame 10 and is arranged and constructed so that, when the reed holder 18 assumes the weft picking position, the recessed portion (78c) of the weft detaching member 78 is spacedly received in the opening 76c of the weft catching member 76. Thus, in response to the pivoting motion of the reed holder 18, the recessed portion (78c) of the weft detaching member 78 gets in and out of the opening 76c permitting the work section 78b to project upward and draw back from the slender portion of the weft catching member 76, as may be understood from FIG. 10. It is to be noted that in this fourth embodiment, the positional relationship between the weft catching member 76 and the weft detaching member 78 are so made that, during the moving back operation of the reed holder 18, the work section 78b of the weft detaching member 78 detaches the weft thread 22 from the vertical wall 76d of the weft catching member 76 just before the time when the weft gripper 12 releases the weft thread 22.

When, in operation, the reed holder 18 and thus the air jet nozzle 16 starts to move back in the upstream direction after completing the beating and the weft thread cutting, the weft thread 22 extending between the weft gripper 12 and the air jet nozzle 16 is brought into engagement with the vertical wall 76d and caught by the same. Thus, the subsequent moving-back operation of the reed holder 18 (which makes a new shed of the warp threads) pulls the "dag" back into the air jet nozzle 16. When the pre-jet operation of the air jet nozzle 16 starts, the shortened dag is forcibly straightened and directed precisely toward the shed of the warp threads by the air jet from the nozzle 16. When the reed holder 18 comes to a predetermined angular position near the position where the weft picking is actually carried out, the work section 78b of the weft detaching member 78 on the reed holder 18 detaches the weft thread 22 from the weft catching member 76, as is seen from FIG. 10. Thus, the length of the weft thread 22 extending from the weft gripper 12 to the air jet nozzle 16 through the weft catching member 76 is sucked into the air jet nozzle 16 making the straightened small dag longer. In this condition, the new shed of the warp threads (not shown) becomes fully open. Then, the weft gripper 12 releases the weft thread 22 causing same to be swiftly picked into the shed of the warp threads.

If desired, an additional work section 78b' may be provided on the weft detaching member 78 in a manner as is indicated by the broken line in FIG. 8. In this case, the weft detaching operation is more reliably achieved.

Figure 11:
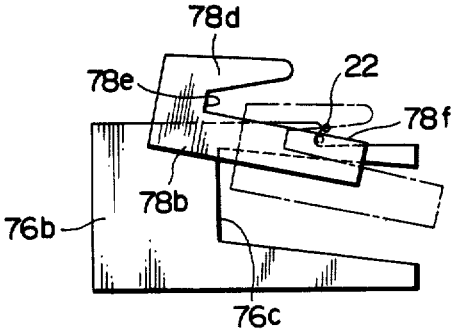
FIG. 11 is a view similar to FIG. 10, but showing a slight modification of the fourth embodiment.

FIG. 11 shows a slight modification of the above-mentioned fourth embodiment of FIG. 8, which is constructed to assure the weft catching function of the weft catching member 76. As shown in FIG. 11, the work section 78b of this modification is formed with an obliquely raised portion 78d leaving a recess 78e between the raised portion 78d and the major portion of the work section 78b. The work section 78b is so arranged and constructed that it can assume the position, indicated by the phantom line, where the inclined inner surface of the raised portion 78d intersects, but spacedly, with the vertical wall 76d of the weft catching member 76. Thus, even when the weft thread 22 is forced to move upward along the vertical wall 76d to the position indicated by the solid line during the moving back operation of the reed holder 18, the weft thread 22 is assuredly prevented from disengaging from the vertical wall 76d until the major portion (or the upper surface 78f) of the work section 78b engages it and lifts up the same.

As is described in the above, in accordance with the present invention, the weft pull-back operation is carried out by skillfully using the pivoting motion of the reed holder 18 relative to the frame 10 of the loom. In fact, the weft pull-back device itself of the present invention is free of the actual weft pulling back motion, but only has a simple weft catching and releasing function. Thus, simplfication of the device and the stable weft picking are achieved in the present invention.

Although the foregoing description is directed to only an air jet weaving loom, the present invention is also applicable to a water jet weaving loom without departing from the scope of the invention.

What is claimed is:

1. In a jet weaving loom having a frame, a reed holder pivotally movable relative to said frame in the downstream and unstream directions with respect to the motion of the warp threads, a jet nozzle movable with said reed holder and ejecting a weft thread into the shed of the warp threads by the jet action thereof, and a weft gripper for intermittently stopping the movement of the weft thread toward the jet nozzle, so that when said reed holder moves in the downstream direction toward a first extreme position, the beating and the weft cutting are carried out, and when said reed holder then moves in the upstream direction and comes to a second extreme position, the weft picking is actually carried out, a weft pull-back device which catches the weft thread extending between said weft gripper and said jet nozzle when said reed holder is positioned in the vicinity of said first extreme position, and holds the same for a predetermined period of time when said reed holder moves in the upstream direction toward said second extreme position after completing the beating and the weft cutting.

2. A weft pull-back device as claimed in claim 1, in which said device comprises:

a structure connected to said frame and comprising two members which are arranged to define therebetween a small clearance which is formed to receive the extending weft thread when said reed holder moves to said first extreme position; and means for locking said extending weft thread in said small clearance for a predetermined period of time when said reed holder moves in the upstream direction.

3. A weft pull-back device as claimed in claim 2, in which the leading ends of said two members of the structure are so formed as to provide the small clearance with a tapered enlarged entrance portion.

4. A weft pull-back device as claimed in claim 2, in which said means comprises:

a cam rotating in response to the weaving operation of the loom;

a lever pivotally connected at its middle portion to said frame, one end of said lever having a cam follower running on said cam;

a work member fixed to the other end of said lever and associated with said structure to lock and unlock said extending weft thread in response to the pivoting motion of said lever; and biasing means for biasing said lever in a direction to press said cam follower against said cam.

5. A weft pull-back device as claimed in claim 4, in which one of the two members of said structure is a spring plate which is bendable to close the entrance portion of said small clearance, and in which said work member is an adjustable screw which is contactable with said spring plate to bend same in response to the pivoting motion of said lever.

6. A weft pull-back device as claimed in claim 4, in which said two members of said structure are formed with aligned holes, and in which said work member is a pin which gets in and out of the aligned holes in response to the pivoting motion of said lever.

7. A weft pull-back device as claimed in claim 1, in which said device comprises:

a cam rotating in response to the weaving operation of the loom;

a lever pivotally connected at its middle portion to said frame, one end of said lever having a cam follower running on said cam;

a hook member fixed to the other end of said lever for catching and releasing said extending weft thread in response to the pivoting motion of said lever; and biasing means for biasing said lever in a direction to press said cam follower against said cam.

8. A weft pull-back device as claimed in claim 1, in which said device comprises:

a weft catching member secured to said frame for catching the extending weft thread at the time when said reed holder starts to move in the upstream direction after completing the beating and the weft cutting; and a weft detaching member secured to said reed holder for detaching the caught weft thread from the weft catching member at the time when said reed holder moves in the upstream direction to a position near the second extreme position.

9. A weft pull-back device as claimed in claim 8, in which said weft catching member comprises a base section adjustably connected to the frame and a raised section extending upwardly from the base section, the raised section having a slender upper portion which extends in the downstream direction to form an opening which faces in the downstream direction, said slender upper portion having a reduced leading end leaving a substantially vertical wall formed thereon.

10. A weft pull-back device as claimed in claim 9, in which said weft detaching member comprises a base section adjustably connected to said reed holder and a work section extending in the upstream direction from said base section, said base section being formed at the portion near the work section with a recess so that when said reed holder assumes said second extreme position, the recessed portion of said base section is spacedly received in the opening of said weft catching member, whereby in response to the pivoting motion of said reed holder, the recessed portion of the weft detaching member gets in and out of said opening of the weft catching member permitting the work section to project upward and draw back from the slender portion of the weft catching member.

11. A weft pull-back device as claimed in claim 10, in which an additional work section is provided to the base section of said weft detaching member in a manner to put said slender portion between the two work sections.

12. A weft pull-back device as claimed in claim 10, in which said work section of said weft detaching member is formed with an obliquely raised portion leaving a recess between the raised portion and the major portion of the work section, said recess facing in the downstream direction, said obliquely raised portion being so arranged and constructed that, during the pivoting motion of said reed holder, the inclined inner surface of said raised portion intersects, but spacedly, with the vertical wall of said weft catching member.

13. A weft pull-back device as claimed in claim 1, in which said jet nozzle is mounted on said reed holder.

14. A weft pull-back device as claimed in claim 1, in which said weft gripper is secured to said frame of the loom for selectively gripping and releasing the weft thread advancing toward the jet nozzle.

* * * * *